US006471753B1

(12) United States Patent
Ahn et al.

(10) Patent No.: US 6,471,753 B1
(45) Date of Patent: Oct. 29, 2002

(54) DEVICE FOR COLLECTING DUST USING HIGHLY CHARGED HYPERFINE LIQUID DROPLETS

(75) Inventors: Kang Ho Ahn, 102-1504, Ichon Apt., 412, Ichon-dong, Yongsan-Ku, Seoul (KR); Jeong Ho Ahn, Seoul (KR); Sang Hyun Ahn, Seoul (KR)

(73) Assignees: Ace Lab., Inc., Taejon (KR); Kang Ho Ahn, Seoul (KR)

( * ) Notice: Subject to any disclaimer, the term of this patent is extended or adjusted under 35 U.S.C. 154(b) by 0 days.

(21) Appl. No.: 09/695,245

(22) Filed: Oct. 25, 2000

(30) Foreign Application Priority Data

Oct. 26, 1999 (KR) ..... 99-46615
Jan. 28, 2000 (KR) ..... 00-4208

(51) Int. Cl.[7] ..... B03C 3/014

(52) U.S. Cl. ..... 96/27; 95/71; 96/53; 96/87; 96/88

(58) Field of Search ..... 96/27, 52, 78, 96/79, 53, 88, 87; 95/64, 65, 71, 72; 239/3, 704, 706, 708

(56) References Cited

U.S. PATENT DOCUMENTS 2,004,352 A * 6/1935 Simon ..... 96/27 X
2,357,354 A * 9/1944 Penney ..... 96/27
2,357,355 A * 9/1944 Penney ..... 96/27
2,525,347 A * 10/1950 Gilman ..... 96/27 X
3,503,704 A * 3/1970 Marks ..... 96/27 X
3,960,505 A * 6/1976 Marks ..... 96/27 X
4,095,962 A * 6/1978 Richards ..... 96/65
4,624,765 A * 11/1986 Cerkanowicz et al. ..... 96/27 X
5,843,210 A * 12/1998 Paranjpe et al. ..... 96/27 X
5,873,523 A 2/1999 Gomez et al. ..... 239/3

FOREIGN PATENT DOCUMENTS

DE 833799 * 3/1952 ..... 96/27
DE 2305723 * 5/1974 ..... 96/27

* cited by examiner

*Primary Examiner*—Richard L. Chiesa
(74) *Attorney, Agent, or Firm*—Lowe Hauptman Gilman & Berner, LLP

(57) ABSTRACT

A device for collecting dust using highly charged hyperfine liquid droplets formed through an electro-hydrodynamic atomization process is disclosed. In the dust collecting device of this invention, a high voltage is applied to capillaries, set within a dust guide duct and having nozzles at their tips. An electric field is thus formed between the capillaries and the duct, and allows the nozzles to spray highly charged hyperfine liquid droplets. Such liquid droplets absorb dust laden in air, flowing in the duct by suction force of a fan. An electrostatic dust collector is detachably coupled to the duct while being insulated from the duct, and forms an electric field having polarity opposite to that of the highly charged liquid droplets, thus electrostatically collecting and removing the dust absorbed by the highly charged liquid droplets. The dust collecting device of this invention easily and effectively removes fine dust having a size smaller than 0.1 cm. This device is also preferably operable at low cost while achieving a desired dust collection effect, and is collaterally advantageous in that it humidifies discharged air, when water is used as the liquid for atomization of the hyperfine liquid droplets.

3 Claims, 4 Drawing Sheets

DEVICE FOR COLLECTING DUST USING HIGHLY CHARGED HYPERFINE LIQUID DROPLETS

BACKGROUND OF THE INVENTION

1. Field of the Invention

The present invention relates to a dust collecting device and method and, more particularly, to a device and method of collecting dust using highly charged hyperfine liquid droplets formed through an electro-hydrodynamic atomization process.

2. Description of the Prior Art

As well known to those skilled in the art, conventional dust collecting devices are classified into two types: electrostatic devices using electrostatic dust precipitators and filtering devices using dust filters. In an operation of the conventional dust collecting devices using the electrostatic participators, target dust is forced to pass through a corona discharge area laden with ions, thus being primarily charged with electricity. Thereafter, the electrically charged dust is exposed to an electric field, and so a desired dust collection effect is achieved. On the other hand, the conventional dust filtering devices using dust filters accomplish a desired dust collection effect by removing the dust using filters. The construction and operation of such conventional dust collecting devices are well known to those skilled in the art regardless of their types, and so further explanation is thus not deemed necessary.

The study of electro-hydrodynamic atomization (EHDA) that is sometimes called "Electrospraying" has been long carried out. In addition, the formation of electrically charged hyperfine liquid droplets has been actively studied in recent years since a variety of industrial fields are very interested in the use of such liquid droplets. Electro-hydrodynamic atomizers have been preferably used for producing highly charged hyperfine liquid droplets. Such atomizers form desired highly charged hyperfine liquid droplets by exposing the droplets to an electric field having a high voltage difference. An example of such conventional electro-hydrodynamic atomizers is referred to U.S. Pat. No. 5,873,523. Hyperfine liquid droplets, produced by such a conventional electro-hydrodynamic atomizer, have a very small size of about several ten nanometers in addition to being highly charged with electricity. Such highly charged hyperfine liquid droplets have been preferably used as, for example, an ion source for mass analyzers.

However, the conventional dust collecting devices are problematic as follows:

That is, the electrostatic dust collecting devices may fail to effectively charge target dust with electricity when the dust has exceedingly hyperfine sizes, even though the devices are preferably operable at low cost due to low pressure drop of their electrostatic precipitators. When the target dust is not effectively charged with electricity as described above, it is almost impossible to electrostatically collect the dust. Another problem experienced with this type of device resides in that the device undesirably generates harmful ozone due to corona discharge.

On the other hand, the dust collecting devices using dust filters are advantageous in that they somewhat effectively remove dust having exceedingly hyperfine sizes. However, this type of device is problematic in that it is increased in its operational cost due to high pressure drop. Another problem with this type of device resides in that it is necessary to repeatedly clean the filter or to repeatedly replace the filter with a new one.

SUMMARY OF THE INVENTION

Accordingly, the present invention has been made keeping in mind the above problems occurring in the prior art, and an object of the present invention is to provide a dust collecting device and method, which is designed to easily and effectively collect and remove dust using highly charged hyperfine liquid droplets formed through an electro-hydrodynamic atomization process.

Another object of the present invention is to provide a dust collecting device and method, which does not generate harmful ozone and is effectively operable at low cost in comparison with conventional dust collecting devices and methods.

In order to accomplish the above objects, the present invention provides a dust collecting device, comprising: a dust guide duct; one or more capillary within the dust guide duct and used for spraying liquid supplied from a liquid supply thereto; a voltage applying means for forming an electric field between the guide duct and the capillary, thus forming highly charged hyperfine liquid droplets sprayed from tip of the capillary; an electric insulating means formed on the external surface of the dust guide duct so as to intercept a voltage undesirably applied to the dust guide duct; a dust sucking means for sucking dust-laden air into the dust guide duct so as to allow dust to be absorbed by the highly charged hyperfine liquid droplets; and a dust collecting means detachably coupled to the dust guide duct while being electrically insulated from the duct, the dust collecting means forming an electric field having a polarity opposite to that of the highly charged hyperfine liquid droplets, thus electrostatically collecting and removing the dust absorbed by the highly charged hyperfine liquid droplets.

The present invention also provides a dust collecting method, comprising the steps of: forming highly charged hyperfine liquid droplets within a dust guide duct through an electro-hydrodynamic atomization process; sucking dust-laden air into the duct so as to allow dust to flow along with the highly charged hyperfine liquid droplets within the duct; absorbing the dust by the highly charged hyperfine liquid droplets; and collecting and removing the dust, absorbed by the highly charged hyperfine liquid droplets, by using dust collecting means, the dust collecting means forming an electric field having a polarity opposite to that of the highly charged hyperfine liquid droplets.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
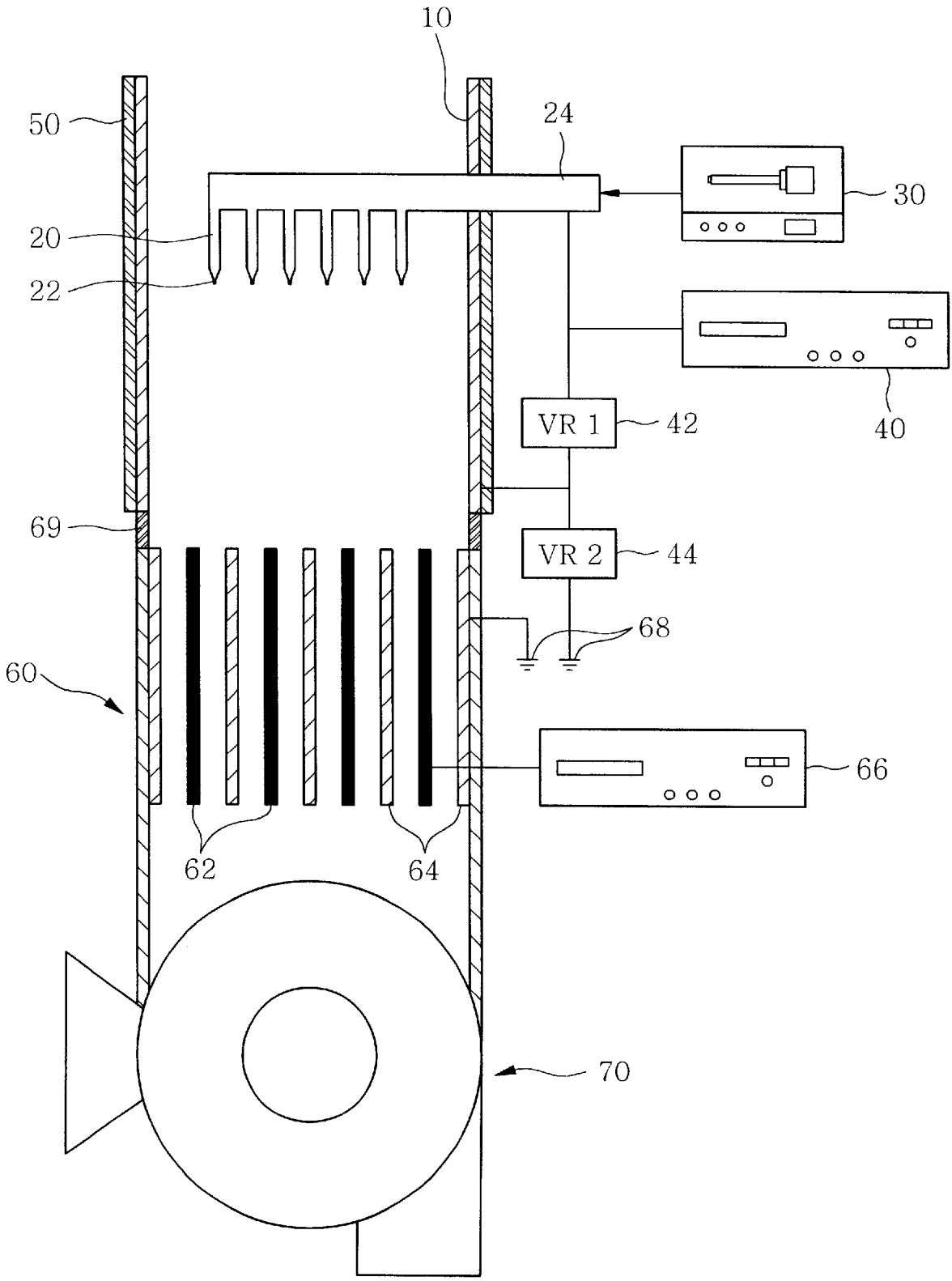
FIG. 1 is a view, schematically showing the construction of a dust collecting device using highly charged hyperfine liquid droplets in accordance with the primary embodiment of the present invention.
Figure 2:
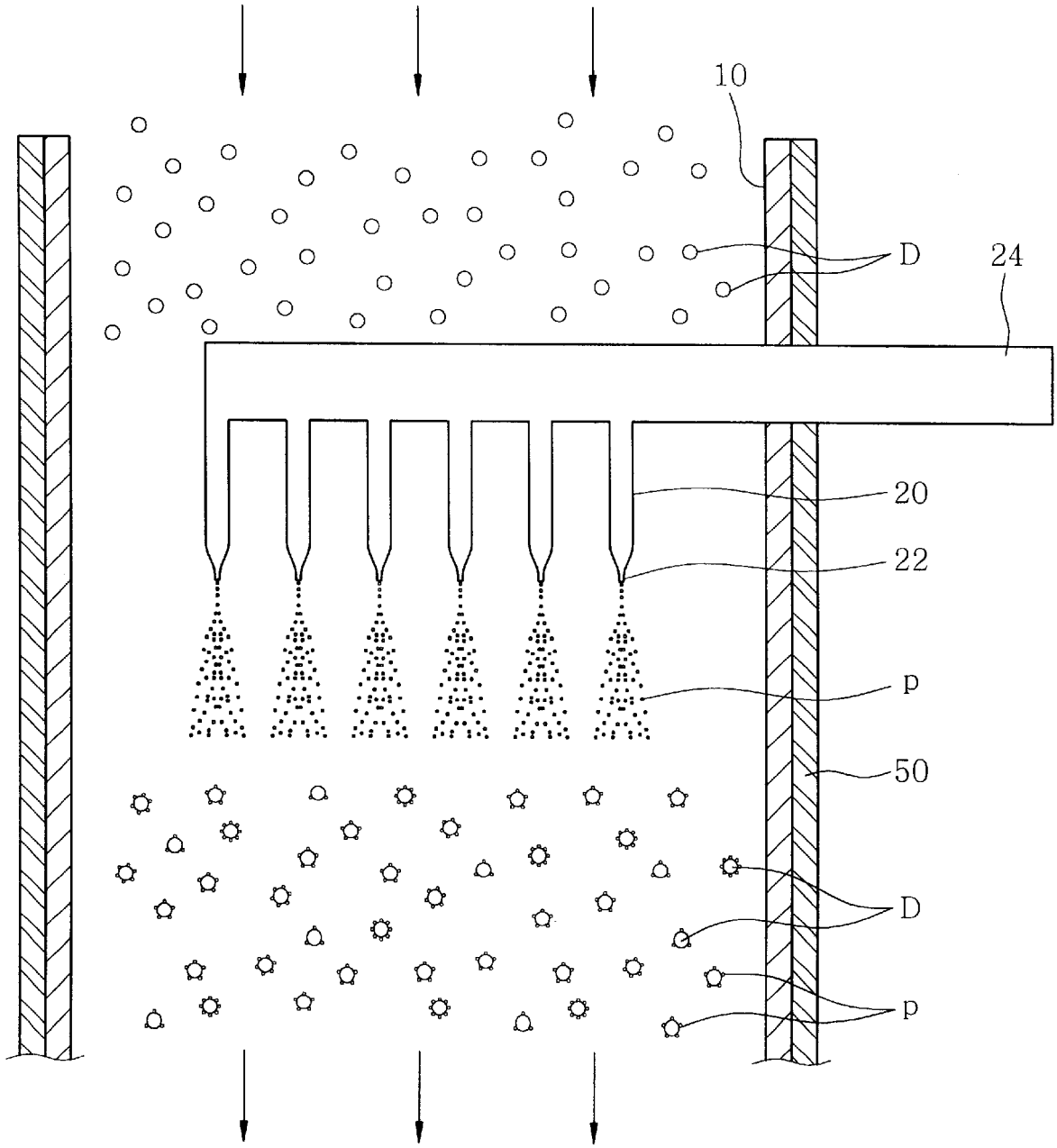
FIG. 2 is a view, showing an electrostatic attachment of the highly charged hyperfine liquid droplets to dust in an operation of the device of FIG. 1.

FIGS. 1 and 2 are views, showing the construction and operation of a dust collecting device using highly charged hyperfine liquid droplets in accordance with the primary embodiment of the present invention. As shown in the drawings, the device according to the primary embodiment of this invention comprises a dust guide duct 10, which is vertically positioned and has a capillary assembly transversely set in the duct 10. The capillary assembly comprises a liquid inlet pipe 24, which transversely passes through the sidewall of the duct 10 to extend from the atmosphere into the duct 10. A plurality of capillaries 20 are commonly branched from the pipe 24 at positions within the duct 10, and parallely extend downward in a vertical direction. Each of the capillaries 20 has a nozzle 22 at the tip, and atomizes liquid, thus forming hyperfine liquid droplets "P". The liquid inlet pipe 24 extends from a liquid supply 30, and so the pipe 24 feeds liquid under pressure from the liquid supply 30 to the capillaries 20 and allows the capillaries 20 to atomize the liquid, thus forming desired hyperfine liquid droplets "P". In the present invention, a conventional pure liquid supply unit provided with a syringe pump for controllably supplying liquid for atomization, such as water, to the pipe 24, or a conventional liquid injector designed to supply liquid using pressurized air or gravity may be preferably used as the liquid supply 30. In addition, it should be understood that the capillaries 20 may be replaced with pipes having a plurality of orifices without affecting the functioning of this invention. It is also understood that the dust guide duct 10 may have a variety of cross-sections, such as a rectangular, circular or hexagonal cross-section, as desired.

In the dust collecting device of this invention, different voltages are applied to the capillaries 20 and the dust guide duct 10. That is, a high voltage from a first high voltage supply 40 is directly applied to the capillaries 20, while a low voltage, formed by dropping the high voltage of the voltage supply 40 using a first variable resistor 42, is applied to the duct 10. In order to intercept a voltage undesirably applied to the duct 10, an insulator layer 50 is coated on the external surface of the duct 10.

An electrostatic dust collector 60 is detachably mounted to the lower end of the duct 10. Two types of dust collecting panels 62 and 64 are parallely, vertically and alternately arranged within the dust collector 60 while forming regular gaps between them. Of the two types of panels 62 and 64, the panels 62 are commonly connected to a second high voltage supply 66, while the other panels 64 are commonly connected to a ground 68. During an operation of the device, air laden with dust "D" flows down within the duct 10, and so the dust "D" is absorbed by the electrically charged hyperfine liquid droplets "P" sprayed from the nozzles 22 of the capillaries 20. The electrically charged liquid droplets "P", absorbing the dust "D", pass through the gaps between the panels 62 and 64. In such a case, the high voltage, applied from the second voltage supply 66 to the dust collecting panels 62, has a polarity opposite to that of the first voltage supply 40, and so the panels 62 electrostatically collect the dust "D" absorbed by the electrically charged hyperfine liquid droplets "P". The construction and operation of such an electrostatic dust collector 60 having the panels 62 and 64 are well known to those skilled in the art, and further explanation is thus not deemed necessary.

An insulator 69 is interposed at the junction between the dust guide duct 10 and the electrostatic dust collector 60, thus electrically insulating the dust guide duct 10 from the electrostatic dust collector 60. In addition, a second variable resistor 44 is connected to the first variable resistor 42, and extends to another ground 68. Therefore, the high voltage from the voltage supply 40 is primarily dropped by the first variable resistor 42, and is secondarily dropped by the second variable resistor 44. In the primary embodiment, the two variable resistors 42 and 44 are used for forming a voltage difference between the dust guide duct 10 and the capillaries 20. However, it should be understood that the variable resistors 42 and 44 may be replaced with fixed resistors without affecting the functioning of this invention. In addition, the same operational effect as that expected from the primary embodiment may be achieved by an application of a high voltage from a high voltage supply to the capillaries 20 and an application of a low voltage from a low voltage supply to the dust guide duct 10 in place of using the single voltage supply 40 and the two resistors 42 and 44.

A blower fan 70 is set in the lower end of the electrostatic dust collector 60 so as to suck dust-laden air into the dust guide duct 10. Of course, it should be understood that the fan 70 may be set in the upper end of the duct 10 in place of the lower end of the dust collector 60 without affecting the functioning of this invention.

Figure 3:
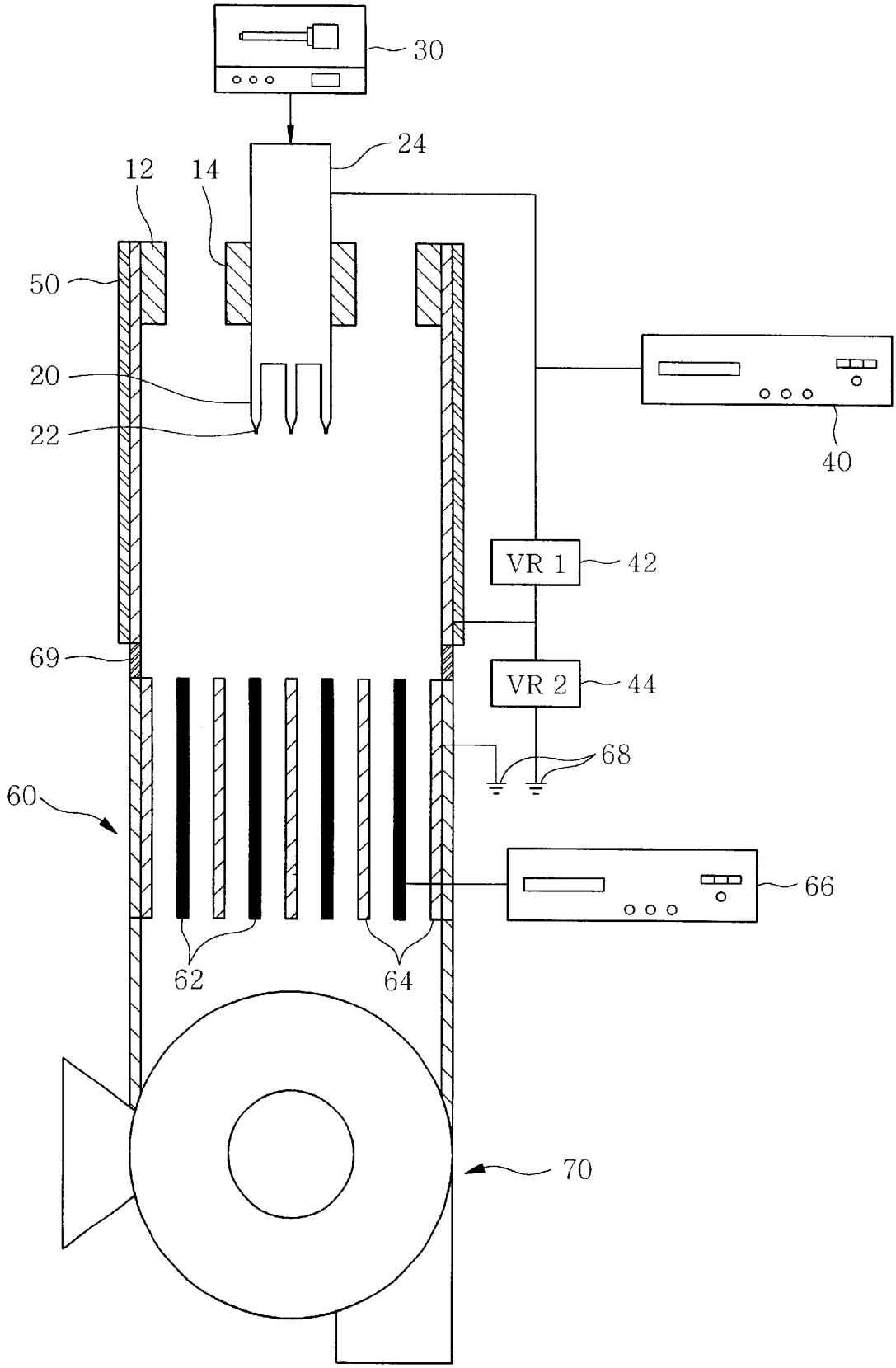
FIG. 3 is a view, schematically showing the construction of a dust collecting device using highly charged hyperfine liquid droplets, with a capillary tube assembly in accordance with the second embodiment of the present invention.

FIG. 3 is a view, schematically showing the construction of a dust collecting device using highly charged hyperfine liquid droplets, with a capillary assembly in accordance with the second embodiment of the present invention. As shown in the drawing, the capillary tube assembly according to the second embodiment is axially set on the dust guide duct 10 different from the transversely set capillary tube assembly of the primary embodiment. That is, a support bracket 12 is fixedly fitted into the upper end of the vertically positioned dust guide duct 10, with a capillary assembly fixedly and axially held by the support bracket 12. In a detailed description, the liquid inlet pipe 24 of the capillary assembly is axially fitted into the center of the support bracket 12, with a plurality of capillaries 20 axially extending downward from the lower end of the pipe 24 to a predetermined length. Of course, it is necessary to fix the position of the liquid inlet pipe 24 relative to the support bracket 12. The support bracket 12 is provided with an opening 14 for allowing dust-laden air to flow from the outside into the dust guide duct 10.

A dust collecting operation of the device according to the present invention will be described herein below.

In an operation of the device, desired hyperfine liquid droplets are primarily formed as follows: That is, when the device is activated, different voltages are applied to the capillaries 20 and the dust guide duct 10. That is, a high voltage from the first high voltage supply 40 is directly applied to the capillaries 20, while a low voltage, formed by dropping the voltage of the voltage supply 40 using the first variable resistor 42, is applied to the duct 10. Therefore, a high voltage gradient is formed in the liquid sprayed from the nozzles 22 of the capillaries 20. In addition, since the liquid is exposed to an electric field at a time when the liquid is sprayed from the nozzles 22, the balance between the liquid's electrostatic attraction force and the surface tension of the liquid is broken. Due to the breakage of this balance, the surface of the sprayed liquid is broken, and forms desired hyperfine liquid droplets "P". The hyperfine liquid droplets "P" have a hyperfine size of about several ten to several hundred nanometers. The liquid droplets "P" are also highly charged with electricity in such a way that the quantity of electricity stored in them reaches the Rayleigh charge limit. In such a case, the highly charged hyperfine liquid droplets "P" have the same polarity.

The highly charged hyperfine liquid droplets "P" flow downward in the vertically positioned dust guide duct 10 as shown in FIG. 2. In such a case, air laden with dust "D" is introduced into the duct 10 due to the suction force produced by the blower fan 70, and forcibly flows to the lower portion of the duct 10. Such a forcible flow of the dust-laden air within the duct 10 enhances the downward flow of the liquid droplets "P". The highly charged hyperfine liquid droplets "P" absorb the dust "D" while flowing in the duct 10 downward. The dust "D", absorbed by the liquid droplets "P", is thus highly charged with electricity.

The highly charged dust "D", absorbed by the hyperfine liquid droplets "P", flows downward in the duct 10, and reaches the electrostatic dust collector 60. In the electrostatic dust collector 60, the highly charged dust "D" passes through the gaps between the alternately arranged two types of dust collecting panels, that is, the panels 62 connected to the second high voltage supply 66 and the panels 64 connected to the ground 68. In such a case, the high voltage, applied from the second voltage supply 66 to the dust collecting panels 62, has a polarity opposite to that of the first voltage supply 40, and so the panels 62 electrostatically collect the highly charged dust "D".

Figure 4:
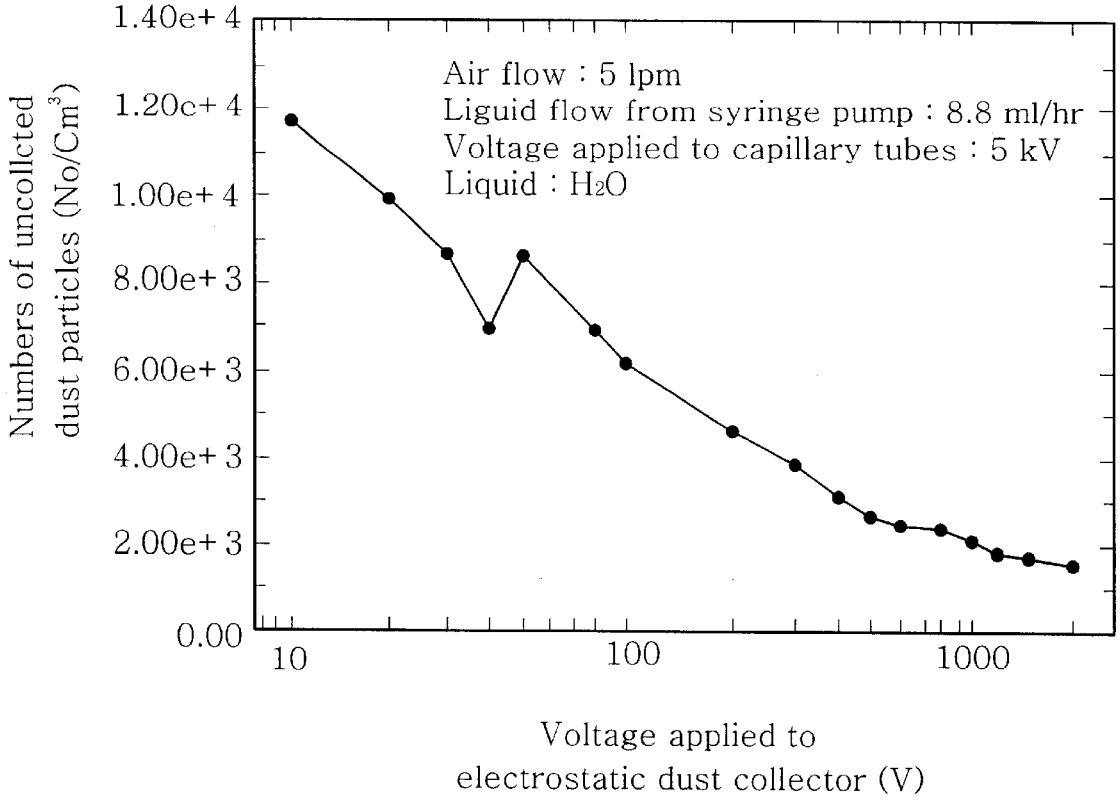
FIG. 4 is a graph, showing the number of uncollected dust particles as a function of voltage applied to an electrostatic dust collector included in the device of this invention.

FIG. 4 is a graph, showing the number of uncollected dust particles as a function of voltage applied to the dust collecting panels 62 from the second voltage supply 66 of this invention. In an experiment for measuring the operational performance of the device of this invention, a dust counter (not shown) was provided in the lower portion of the electrostatic dust collector 60 for counting the number of uncollected dust particles, which were discharged from the dust collector 60 without being collected by the panels 62. As expressed in the graph of FIG. 4, when a voltage higher than 1,000 V was applied from the second voltage supply 66 to the dust collecting panels 62, the number of uncollected dust particles was remarkably reduced in comparison with an application of a low voltage of 10 V to the panels 62. The experiment exhibited that the dust collecting device according to the present invention very effectively removed up to about 90% of dust from air.

When water is used as the liquid for atomization of the hyperfine liquid droplets during an operation of the device of this invention, the device is collaterally advantageous in that it humidifies the discharged air.

As described above, the present invention provides a dust collecting device and method, which easily and effectively collects and removes dust by forming highly charged hyperfine liquid droplets through an electro-hydrodynamic atomization process and by allowing the dust to be absorbed by such liquid droplets. The device and method of this invention easily and effectively removes fine dust having a size smaller than 0.1 :m. The device and method is also preferably operable at low cost while achieving a desired dust collection effect. The dust collecting device and method is collaterally advantageous in that it humidifies discharged air, when water is used as the liquid for atomization of the hyperfine liquid droplets.

The dust collecting device and method of this invention is preferably used for a variety of applications, wherein it is necessary to remove environmental pollutants, such as dust, smoke, pollen, allergens and oil mist. In addition, the device and method of this invention is also preferably used in small-scale air conditioning systems, such as room air conditioners or room air cleaners.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A dust collecting device, comprising:

a dust guide duct;

one or more capillary within said dust guide duct and used for spraying liquid supplied from a liquid supply thereto;

voltage applying means for forming an electric field between said guide duct and said capillary, and a high voltage being applied to said capillary and a low voltage being applied to said guide duct, thus forming highly charged hyperfine liquid droplets sprayed from a tip of the capillary;

electric insulating means formed on an external and entire surface of said dust guide duct so as to intercept the low voltage undesirably applied to the dust guide duct;

dust sucking means for sucking dust-laden air into the dust guide duct so as to allow dust to be absorbed by said highly charged hyperfine liquid droplets; and dust collecting means detachably coupled to said dust guide duct while being electrically insulated from said duct, said dust collecting means forming an electric field having a polarity opposite to that of said highly charged hyperfine liquid droplets, thus electrostatically collecting and removing the dust absorbed by the highly charged hyperfine liquid droplets.

2. The dust collecting device according to claim 1, wherein said voltage applying means comprises one voltage supply and a plurality of variable resistors.

3. The dust collecting device according to claim 1, wherein a support bracket is fitted into said dust guide duct, with the capillary held by the support bracket while penetrating the support bracket, said support bracket being provided with an opening for allowing the interior of said dust guide duct to communicate with the outside of said duct.

* * * * *